United States Patent [19]

Newton, Jr.

[11] Patent Number: 5,033,738

[45] Date of Patent: Jul. 23, 1991

[54] RUNNER'S STARTING BLOCK ASSEMBLY

[76] Inventor: Milton A. Newton, Jr., 4392 Pampas Rd., Woodland Hills, Calif. 90249

[21] Appl. No.: 363,104

[22] Filed: Jun. 6, 1989

[51] Int. Cl.[5] ..... A63K 3/02

[52] U.S. Cl. ..... 272/105

[58] Field of Search ..... 272/105, 100

[56] References Cited

U.S. PATENT DOCUMENTS

| | | | |
|---|---|---|---|
| 2,890,048 | 6/1959 | Holmes | 272/105 |
| 2,937,871 | 5/1960 | McCafferty | 272/105 |
| 3,608,897 | 9/1971 | Ross | 272/105 |
| 3,746,335 | 7/1973 | Fichter et al. | 272/105 |
| 4,561,650 | 12/1985 | Newton, Jr. | 272/105 |

FOREIGN PATENT DOCUMENTS

| | | | |
|---|---|---|---|
| 2199503 | 7/1988 | United Kingdom | 272/105 |

*Primary Examiner*—Richard J. Apley
*Assistant Examiner*—D. F. Crosby
*Attorney, Agent, or Firm*—William P. Green

[57] ABSTRACT

A central, length-delineated spine is formed by successive U shaped arms to which a pair of novel starting blocks can be attached, one on each side, and slid to such positions as desired by the runner. Each starting block is formed with a hollow open bottom side housing or box which will fit down over an anchorage block carried by successive U arms so as to lock the two together at a particular position along the spine. When raised free of such lockage, a starting block can be slid lengthwise due to (a) a pair of projecting lips or edge rails formed lengthwise along the starting block and along the hollow housing, and (b) composite slide rails formed by alignment of successive anchor blocks of a line of arms. Such starting blocks are easily raised and slid to new positions but cannot fall off the assembly (which might injure a foot) even if the assembly is inverted.

10 Claims, 1 Drawing Sheet

RUNNER'S STARTING BLOCK ASSEMBLY

Every track runner is familiar with the pair of starting blocks against which he braces his feet at the start of a race. In general, they have to have enough support material to keep them in place at the starting position and also to be selectively adjustable for changing the angle to one which the runner desires. Specifically, the starting block has enough weight that the runner doesn't want it to fall on his foot, so it would seem desirable that all pieces (such as three) were coupled together for handling. Accordingly there is provided such an assembly in which such pair of starting blocks is easily movable (slidable) along a frame and cannot fall off even if the whole frame is inverted. This is accomplished by provision of a series of interrupted tracks formed by laterally projecting lips or edge rails which keep the blocks loose enough for free movement, plus lock or anchor means which hold a respective block at a selected position, such as may be provided, say, an inch apart along a positioning spine or frame. In the drawings FIG. 1 is a top plan view of the assembly, showing the two starting blocks is use position.

Figure 1:
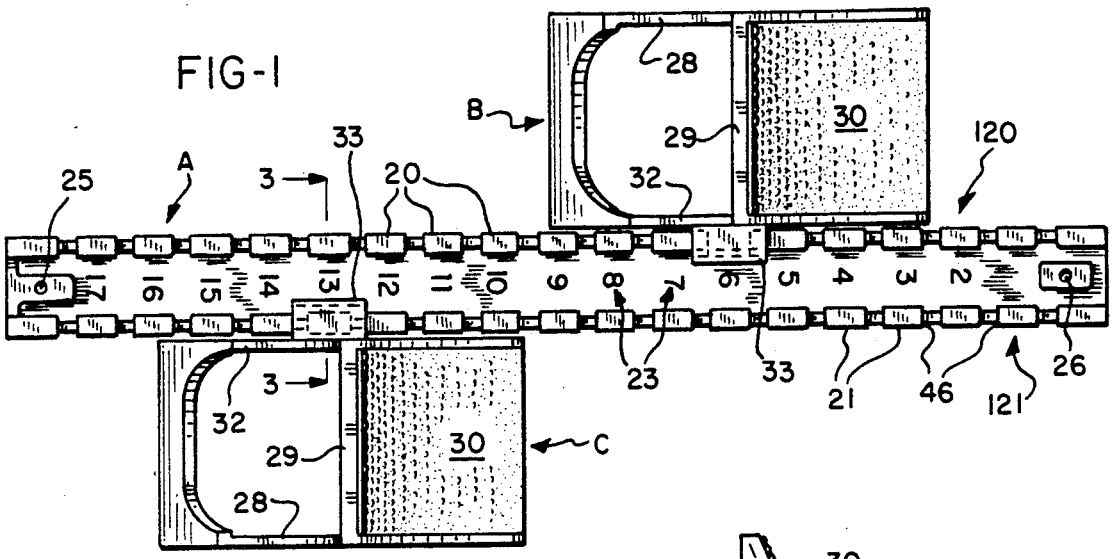

The assembly is based on a horizontal, flat-bottom spine. A generally U shaped in transverse section by reason of similar edge rows of upstanding arms 20, 21 forming two parallel guide rails or tracks 120 and 121 respectively, with the arms being of equal size and, uniformly spaced apart at a series of notches 46, and thus serving as units of length measurement. Indicia of such units 23 thus indicate the length of the spine (in feet or centimeters) and the linear separation of the pair of starting blocks B, C becomes readily visible. Within the trough of the U, at each end of the spine is a vertically apertured post 25, 26, through which a spike 27 may be driven into the ground or tarmac to anchor the assembly.

Each of the starting blocks B, C is formed of a base frame 28 and a forward, upwardly arced backing plate 29 which is overlaid with a resilient layer of synthetic plastic or the like 30. An inner, upstanding side wall 32 of the frame 28 carries a laterally projecting, open bottom, box housing 33 which is of such size and shape as to loosely receive a rectangular anchor block 35 of one of the arms 20 or 21, and thus anchor an adjacent foot block B or C at an indicia-marked position.

Figure 4:
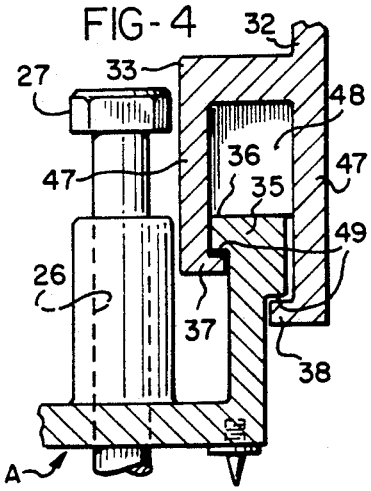
FIG. 4 is an enlarged detail of the right of FIG. 3 in disengaged position.

Each anchor 35 (corresponding in number to the number of indicia) is located for engagement with a pair of rail segments formed by respective lips 37, 38 (FIG. 4) forming shoulders projecting from side walls 47 of the housing box 33. The inturned lip 37 of the housing 33 thus forms a longitudinal slide rail as does the opposite inturned lip or shoulder 38. underface of the anchor block 35 including its flat top 36 forms part of a composite slideway passing through housing 33. The length of an anchor block longitudinally of the spine corresponds to the length of an arm 20, 21 which is marked by the indicia 23.

Figure 2:
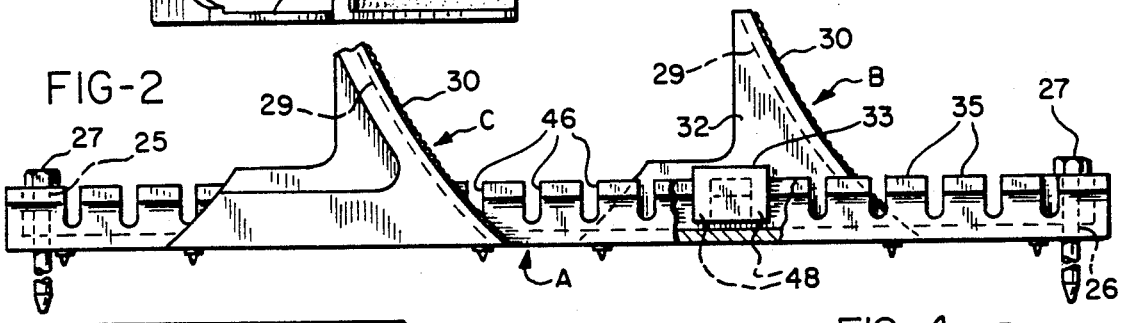
FIG. 2 is a side elevational view of the same with the block coupling unit visible by the spine being cut away.
Figure 3:
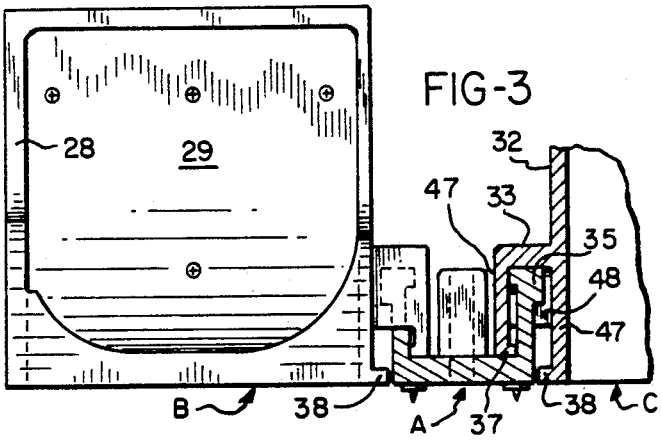
FIG. 3 is a transverse section taken along the line 3—3 of FIG. 1 with the anchorage mechanism shown in locking position.

In the condition of FIGS. 2 and 3, the housings 33 of starting blocks B and C are received about two of the arms 20 and 21 of tracks 120 and 121, with the front and rear walls 48 of each housing projecting downwardly into two of the notches 46 in the tracks, to thereby lock the starting blocks against movement longitudinally of spine A from particular selected settings. The starting blocks may be similarly locked in any of various other settings by moving their housings 33 downwardly about others of the arms 20 and 21. At any of these locations, the starting blocks may be moved upwardly to a released position such as that shown in FIG. 4, in which walls 48 are received entirely above the level of upper surfaces 36 of anchor blocks 35, to thus free the starting locks B and C for shifting movement longitudinally of the spine and its two tracks, to changed settings. In the FIG. 4 position, the lips or shoulders 37 and 38 of each housing 33 are engageable upwardly against coacting shoulders 49 formed at the underside of an anchor block 35, to prevent further upward movement of the starting block B or C and thus positively retain the starting block against complete separation from the spine A even if the spine is inverted.

Figure 5:
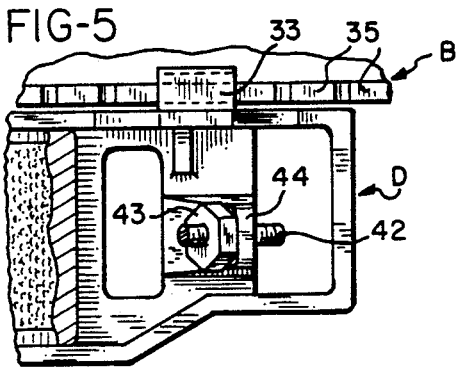
FIG. 5 is a top plan view of a portion of a starting block having a tilt adjustable foot support.
Figure 6:
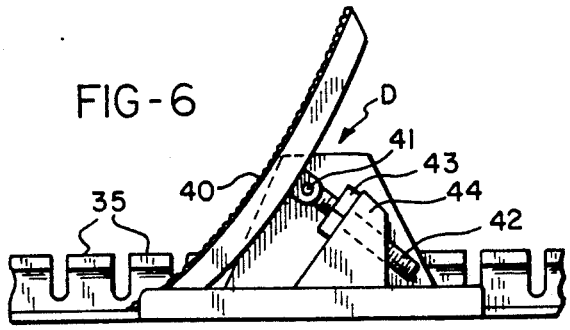
FIG. 6 is an elevational view of the mechanism of FIG. 5.

FIGS. 5–6 show an adjustable foot block D wherein the foot support plate 40 is pivotally attached at 41 to a threaded stylus 42 which carries a manually adjustable nut 43 which rests against an abutment 44. Accordingly, manual positioning of the nut serves to change the angle of elevation of the foot block.

A starting block assembly which lacks the present slide tracks is seen in U.S. Pat. No. 3,724,843 to Fichter et al. Apr. 3, 1973. Nothing is done to keep the starting blocks from falling off.

I claim:

1. A runner's starting block assembly comprising in combination: an elongated spine, transversely U shaped with two parallel rows of spaced upstanding arms, each arm having a top anchor block forming a composite longitudinal slide track with similar anchor blocks of others of the arms, each anchor block on said individual arms having inner and outer side faces, each face, being formed on a projecting shoulder, a runner's starting block disposed adjacent each of said rows of upstanding arms, each starting block being formed with a laterally projecting open-bottom housing disposed for selective insertion anchorage of one of said anchor blocks therein, and said housing carrying a longitudinal lip disposed to move upwardly into engagement with one of said shoulders of said arms when the anchor block is withdrawn from anchorage position, in a relation preventing complete separation of said starting blocks from the spine while permitting each starting block to be slid lengthwise along the corresponding track when said anchor block is thus withdrawn from said housing.

2. A runner's starting block assembly comprising in combination: an elongated spine formed by a longitudinal row of spaced individual arms, said arms having selective anchorage means for a runner's starting block therealong and forming a composite slide rail for such starting block, a runner's starting block which is connected to said arms for longitudinal movement slidably along said composite rail formed by the arms and for movement upwardly and downwardly relative to the rail between a lower active position in which the block is retained against movement longitudinally with respect to the rail and an upper position permitting such longitudinal movement; and shoulders projecting from the rail and from the starting block which are engagable by upward movement of the starting block in a relation retaining said starting block against complete separation from the arms in said upper position of the block.

3. The assembly of claim 2 wherein said runner's starting block is tilt adjustable.

4. A starting block assembly comprising:

an elongated spine of generally U-shaped transverse section defining two generally parallel upwardly projecting guide tracks each containing a series of spaced upwardly facing notches; and two starting blocks mounted to said two tracks respectively for sliding movement longitudinally therealong and having surfaces against which a runner braces his feet in starting a race;

each starting block being movable upwardly and downwardly relative to the corresponding track, between a lower position and an upper position, at any of a series of different locations along the track, and having a portion which in said lower position is received within one of said notches to lock the block against movement longitudinally along the track, and which in said upper position is withdrawn from the notch to free the starting block for such movement longitudinally of the track, each of said starting blocks and the corresponding track having shoulders which become engaged with one another by the upward movement of the starting block to said upper position thereof, in a relation preventing complete separation of the block from the track.

5. A starting block assembly as recited in claim 4, in which each of said starting blocks has two of said portions forming two spaced transverse walls which are receivable within two of said notches in said lower position of the block.

6. A starting block assembly as recited in claim 4, in which each of said starting blocks has two spaced side walls received at opposite sides of the corresponding track to guide the block for movement longitudinally along the track.

7. A starting block assembly as recited in claim 4, in which each of said tracks forms a series of upstanding arms between said notches; and each starting block has a laterally projecting open bottom housing which is adapted to be received about one of said arms in said lower position of the starting block and which forms said portion of the starting block received within one of the notches.

8. A starting block assembly as recited in claim 7, in which each starting block has two of said portions forming front and rear walls of said housing and receivable in two of said notches in said lower position of the starting block;

said housing having two opposite side walls receivable at opposite sides of one of said arms in said lower position of the starting block.

9. A starting block assembly as recited in claim 8, in which said shoulders include shoulders formed on said arms and on said side walls of said housing engageable to limit upward movement of the housing relative to said arms.

10. A starting block assembly as recited in claim 4, in which each of said starting blocks has two spaced side walls received at opposite sides of the corresponding track to guide the block for movement longitudinally along the track; said shoulders including shoulders formed on said side walls and on the corresponding track engageable in said upper position of a starting block to limit upward movement of the side walls relative to the track and thereby prevent complete detachment of the starting block from the track.

* * * * *